US008439253B2

(12) United States Patent
Requena et al.

(10) Patent No.: US 8,439,253 B2
(45) Date of Patent: May 14, 2013

(54) CARTON

(75) Inventors: Emili Requena, Igualada (ES); Ana Gonzalez, Igualada (ES)

(73) Assignee: Graphic Packaging International, Inc., Marietta, GA (US)

( * ) Notice: Subject to any disclaimer, the term of this patent is extended or adjusted under 35 U.S.C. 154(b) by 390 days.

(21) Appl. No.: 12/770,098

(22) Filed: Apr. 29, 2010

(65) Prior Publication Data

US 2011/0101078 A1 May 5, 2011

(30) Foreign Application Priority Data

Oct. 30, 2009 (EP) ..... 09013688

(51) Int. Cl.
*B65D 5/46* (2006.01)

(52) U.S. Cl.
USPC ..... 229/117.13; 229/120; 229/920

(58) Field of Classification Search ..... 229/117.12, 229/117.13, 117.14, 117.23, 120, 916, 920; 206/427
See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |
| 3,127,720 | A | 4/1954 | Gentry et al. |
| 2,702,144 | A | 2/1955 | Forrer |
| 2,797,856 | A | 7/1957 | Jaeschke |
| 2,810,506 | A | 10/1957 | Kessler |
| 2,868,433 | A | 1/1959 | Anderson, Jr. |
| 2,955,739 | A | 10/1960 | Collura |
| 3,076,591 | A | 2/1963 | Nute et al. |
| 3,112,856 | A | 12/1963 | MacIntosh et al. |
| 3,204,815 | A | 9/1965 | Weiss |
| 3,309,005 | A | 3/1967 | Pilger |
| 3,334,767 | A | 8/1967 | Cornelius et al. |
| 3,355,012 | A | 11/1967 | Weiss |
| 3,381,881 | A | 5/1968 | Granz et al. |
| 3,828,926 | A | 8/1974 | Rossi |
| 3,886,901 | A | 6/1975 | Zeitter |

(Continued)

FOREIGN PATENT DOCUMENTS

| | | |
|---|---|---|
| CA | 877792 | 8/1971 |
| CA | 2 160 145 | 9/1995 |

(Continued)

OTHER PUBLICATIONS

International Search Report and Written Opinion dated Jan. 3, 2011 from PCT/US2010/035498.

*Primary Examiner* — Gary Elkins
(74) *Attorney, Agent, or Firm* — Womble Carlyle Sandridge & Rice, LLP

(57) ABSTRACT

A blank, carton, or package including a handle formed in a top panel is described. Deformation lines can be included on the blank or carton to allow the handle to flex, thereby increasing handle strength. The blank can include corner-forming panels attached to end flaps that can be used to form corners in the formed carton or package. The corners provide reinforcement strength to allow stacking of the cartons or packages, such as on pallets or during shipment. Openings can be provided in select areas of the blank, carton, or package to allow ventilation to and from the interior of the carton or package. Connecting panels in the top panel can be removed to dispense articles from the carton or package.

26 Claims, 11 Drawing Sheets

U.S. PATENT DOCUMENTS

| | | | | |
|---|---|---|---|---|
| 3,904,036 | A | 9/1975 | Forrer | |
| 3,933,303 | A | 1/1976 | Kirby, Jr. | |
| 3,994,432 | A | 11/1976 | Kirby, Jr. | |
| 4,029,204 | A | 6/1977 | Manizza | |
| 4,036,423 | A | 7/1977 | Gordon | |
| 4,096,985 | A | 6/1978 | Wood | |
| 4,111,306 | A | 9/1978 | Roccaforte | |
| 4,216,861 | A | 8/1980 | Oliff | |
| 4,318,474 | A | 3/1982 | Hasegawa | |
| 4,329,923 | A | 5/1982 | Iida | |
| 4,331,289 | A | 5/1982 | Killy | |
| 4,364,509 | A | 12/1982 | Holley, Jr. et al. | |
| 4,375,258 | A | 3/1983 | Crayne et al. | |
| 4,378,905 | A | 4/1983 | Roccaforte | |
| 4,382,505 | A | 5/1983 | Sutherland et al. | |
| 4,424,901 | A | 1/1984 | Lanier | |
| 4,440,340 | A | 4/1984 | Bakx | |
| 4,478,334 | A | 10/1984 | Graser | |
| 4,498,619 | A | 2/1985 | Roccaforte | |
| 4,508,258 | A | 4/1985 | Graser | |
| 4,538,759 | A | 9/1985 | Dutcher | |
| 4,545,485 | A | 10/1985 | Oliff | |
| 4,546,914 | A | 10/1985 | Roccaforte | |
| 4,588,084 | A | 5/1986 | Holley, Jr. | |
| 4,653,686 | A | 3/1987 | Wood et al. | |
| 4,706,876 | A | 11/1987 | Wilson | |
| 4,747,487 | A | 5/1988 | Wood | |
| 4,784,266 | A | 11/1988 | Chaussadas | |
| 4,784,316 | A | 11/1988 | Crouch | |
| 4,802,583 | A | 2/1989 | Calvert et al. | |
| 4,830,267 | A | 5/1989 | Wilson | |
| 4,875,586 | A | 10/1989 | Chaussadas | |
| 4,966,324 | A | 10/1990 | Steel | |
| 4,989,778 | A * | 2/1991 | Saulas | 229/117.13 |
| 5,020,337 | A | 6/1991 | Krieg | |
| 5,060,792 | A | 10/1991 | Oliff | |
| 5,094,359 | A | 3/1992 | DeMars et al. | |
| 5,106,014 | A | 4/1992 | Miller | |
| 5,119,985 | A | 6/1992 | Dawson et al. | |
| 5,197,598 | A | 3/1993 | Stout et al. | |
| 5,221,041 | A | 6/1993 | Stout et al. | |
| 5,222,658 | A | 6/1993 | DeMaio et al. | |
| 5,234,102 | A | 8/1993 | Schuster et al. | |
| 5,246,112 | A | 9/1993 | Stout et al. | |
| 5,284,294 | A | 2/1994 | Floyd | |
| 5,292,058 | A | 3/1994 | Zoss et al. | |
| 5,297,725 | A | 3/1994 | Sutherland | |
| 5,303,863 | A | 4/1994 | Arasim | |
| 5,307,932 | A | 5/1994 | Stout et al. | |
| 5,307,986 | A | 5/1994 | Schuster | |
| 5,320,277 | A | 6/1994 | Stout et al. | |
| 5,328,081 | A | 7/1994 | Saulas | |
| 5,333,734 | A | 8/1994 | Stout et al. | |
| 5,379,944 | A | 1/1995 | Stout et al. | |
| 5,381,891 | A | 1/1995 | Harris | |
| 5,385,234 | A | 1/1995 | Stout et al. | |
| 5,395,044 | A | 3/1995 | Stout | |
| 5,427,241 | A | 6/1995 | Sutherland | |
| 5,458,234 | A | 10/1995 | Harris | |
| 5,485,915 | A | 1/1996 | Harris | |
| 5,495,727 | A | 3/1996 | Strong et al. | |
| 5,503,324 | A | 4/1996 | Bacchetti et al. | |
| 5,524,756 | A | 6/1996 | Sutherland | |
| 5,551,556 | A | 9/1996 | Sutherland | |
| 5,582,343 | A | 12/1996 | Dalvey | |
| 5,639,017 | A | 6/1997 | Fogle | |
| 5,647,483 | A | 7/1997 | Harris | |
| 5,669,500 | A | 9/1997 | Sutherland | |
| 5,699,957 | A | 12/1997 | Blin et al. | |
| 5,704,470 | A | 1/1998 | Sutherland | |
| 5,738,273 | A | 4/1998 | Auclair | |
| 5,794,778 | A | 8/1998 | Harris | |
| 5,826,782 | A | 10/1998 | Stout | |
| 5,873,515 | A | 2/1999 | Dunn et al. | |
| 5,878,946 | A | 3/1999 | Frerot et al. | |
| 5,915,546 | A | 6/1999 | Harrelson | |
| 5,992,733 | A | 11/1999 | Gomes | |
| 5,996,883 | A * | 12/1999 | Bates | 229/117.13 |
| 6,019,276 | A | 2/2000 | Auclair | |
| 6,065,590 | A | 5/2000 | Spivey | |
| 6,105,853 | A | 8/2000 | Lamare | |
| 6,105,854 | A | 8/2000 | Spivey et al. | |
| 6,131,803 | A | 10/2000 | Oliff et al. | |
| 6,164,526 | A | 12/2000 | Dalvey | |
| 6,170,741 | B1 | 1/2001 | Skolik et al. | |
| 6,227,367 | B1 | 5/2001 | Harrelson et al. | |
| 6,237,839 | B1 * | 5/2001 | Brown | 229/117.13 |
| 6,241,083 | B1 * | 6/2001 | Harrelson | 206/427 |
| 6,260,755 | B1 | 7/2001 | Bates et al. | |
| 6,302,320 | B1 | 10/2001 | Stout | |
| 6,425,520 | B1 | 7/2002 | Peterson | |
| 6,523,739 | B2 | 2/2003 | Heeley et al. | |
| 6,536,656 | B2 * | 3/2003 | Auclair et al. | 229/117.13 |
| 6,598,784 | B2 | 7/2003 | LaBras et al. | |
| 6,631,803 | B2 | 10/2003 | Rhodes et al. | |
| 6,758,337 | B2 | 7/2004 | Chargueraud et al. | |
| 6,848,573 | B2 | 2/2005 | Gould et al. | |
| 6,905,066 | B2 | 6/2005 | Holley, Jr. et al. | |
| 6,926,193 | B2 | 8/2005 | Smalley | |
| 7,007,836 | B2 | 3/2006 | Smalley | |
| 7,427,010 | B2 | 9/2008 | Sutherland | |
| 7,472,791 | B2 | 1/2009 | Spivey, Sr. | |
| 7,743,968 | B2 | 6/2010 | Theelen | |
| 7,748,603 | B2 | 7/2010 | Fogle et al. | |
| 7,757,933 | B2 | 7/2010 | Dunn | |
| 7,806,314 | B2 | 10/2010 | Sutherland | |
| 2001/0017314 | A1 | 8/2001 | Boukredine et al. | |
| 2003/0213263 | A1 | 11/2003 | Woog | |
| 2004/0074954 | A1 | 4/2004 | Fogle et al. | |
| 2005/0056658 | A1 | 3/2005 | Spivey | |
| 2005/0167478 | A1 | 8/2005 | Holley, Jr. | |
| 2006/0169755 | A1 | 8/2006 | Spivey | |
| 2006/0273143 | A1 | 12/2006 | Finch | |
| 2007/0039846 | A1 | 2/2007 | Spivey | |
| 2007/0051781 | A1 | 3/2007 | Holley | |
| 2007/0108261 | A1 | 5/2007 | Schuster | |
| 2007/0164091 | A1 | 7/2007 | Fogle et al. | |
| 2007/0205255 | A1 | 9/2007 | Dunn | |
| 2007/0295789 | A1 | 12/2007 | Ho Fung | |
| 2008/0067223 | A1 | 3/2008 | Jego | |
| 2009/0014508 | A1 | 1/2009 | Marie | |
| 2009/0236408 | A1 | 9/2009 | Spivey, Sr. et al. | |

FOREIGN PATENT DOCUMENTS

| | | | |
|---|---|---|---|
| CH | 536 757 | A | 5/1973 |
| DE | 85 14 718 | | 6/1985 |
| DE | 93 13 241 | U1 | 12/1993 |
| DE | 296 07 374 | U1 | 7/1996 |
| DE | 201 12 228 | | 11/2002 |
| DE | 20 2004 018 649 | U | 5/2005 |
| EP | 0 473 266 | A1 | 3/1992 |
| EP | 0 500 258 | A2 | 8/1992 |
| EP | 1381545 | A1 | 1/2004 |
| EP | 1 612 157 | | 1/2006 |
| FR | 2 481 231 | A1 | 10/1981 |
| FR | 2 662 141 | A1 | 11/1991 |
| GB | 2 206 565 | A | 1/1989 |
| JP | 2004-521032 | A | 7/2004 |
| KR | 10-0785977 | B1 | 12/2007 |
| OA | 128 | A | 1/1966 |
| WO | WO 81 00090 | A1 | 1/1981 |
| WO | WO 95/11165 | A1 | 4/1995 |
| WO | WO 96/20874 | A1 | 7/1996 |
| WO | WO 96/21604 | | 7/1996 |
| WO | WO 96/27538 | | 9/1996 |
| WO | WO 99/28207 | | 6/1999 |
| WO | WO 00/78618 | A1 | 12/2000 |
| WO | WO 01/66434 | | 9/2001 |
| WO | WO 02/47990 | A2 | 6/2002 |
| WO | WO 02/085739 | A1 | 10/2002 |
| WO | WO 03/037742 | | 5/2003 |
| WO | WO 2005/080218 | | 9/2005 |
| WO | WO 2005/123532 | | 12/2005 |
| WO | WO 2007/089282 | A2 | 8/2007 |

* cited by examiner

CARTON

CROSS-REFERENCE TO RELATED APPLICATION

This application claims the benefit of European Patent Application No. 09013688.8, filed Oct. 30, 2009, which is incorporated by reference herein it its entirety.

TECHNICAL FIELD

The present disclosure generally relates to blanks, packages, or cartons for holding and/or dispensing product.

BACKGROUND OF THE DISCLOSURE

Cartons are useful for holding articles, such as containers, products, fruit, vegetables, etc. In order to facilitate transportation of articles from one location to another, it is also beneficial to be able to stack cartons.

SUMMARY OF THE DISCLOSURE

A blank, carton, or package including a handle formed in a top panel is described. Deformation lines can be included on the blank or carton to allow the handle to flex, thereby increasing handle strength. The blank can include corner-forming panels attached to end flaps that can be used to form corners in the formed carton or package. The corners provide reinforcement strength to allow stacking of the cartons or packages, such as on pallets or during shipment. Openings can be provided in select areas of the blank, carton, or package to allow ventilation to and from the interior of the carton or package. Connecting panels in the top panel can be removed to dispense articles from the carton or package.

In one aspect, a carton is provided. The carton includes a first side panel, a second side panel, a top panel, a bottom panel, and an adhesive panel. The top panel includes a handle and a plurality of connecting panels. A plurality of deformation lines are provided in at least two of the first side panel, the second side panel, and the adhesive panel. The carton deforms along at least some of the deformation lines on lifting of the handle. Optionally, each end of the top panel of the carton includes end flaps, and the plurality of deformation lines include deformation lines in each of the top panel end flaps. The handle and plurality of connecting panels are generally spaced apart by openings. Optionally still, the first side panel and the top panel are connected along a first transverse fold line. The openings can extend to, but not across, the first transverse fold line, or the openings can extend from the top panel, across the first transverse fold line, and into one of the top panel end flaps.

Further, the first side panel and the top panel can be connected along a first fold line, with the openings extending to, but not across, the first fold line, or with the openings extending from the top panel, across the first fold line, and into the first side panel.

Further still, the first end flaps can be connected along a first transverse fold line to the first side panel at a first end of the carton, and the first end flaps can include corner forming end flaps that form a first corner at the first end of the carton. The second end flaps can be connected along a second transverse fold line to the first side panel at a second end of the carton, and the second end flaps can include corner forming end flaps that form a second corner at the second end of the carton. The third end flaps can be connected along the first transverse fold line to the second side panel at the first end of the carton, and the third end flaps can include corner forming end flaps that form a third corner at the first end of the carton. The fourth end flaps can be connected along the second transverse fold line to the second side panel at the second end of the carton, and the fourth end flaps can include corner forming end flaps that form a fourth corner at the second end of the carton. Still further, openings can be provided in at least two of the first side panel, the top panel, the second side panel, and the bottom panel. Even further, openings can be provided in at least two of the first side panel, the top panel, the second side panel, and the bottom panel.

In another aspect, a blank can be provided that includes a first side panel connected along a first fold line to a top panel, the top panel connected along a second fold line to a second side panel, the second side panel connected along a third fold line to a bottom panel, the bottom panel connected along a fourth fold line to an adhesive panel, the top panel including a handle and a plurality of connecting panels spaced apart by openings, a first end flap connected along a first transverse fold line to the first side panel, a first top panel end flap connected along the first transverse fold line to the top panel, a second end flap connected along the first transverse fold line to the second side panel, a first bottom panel end flap connected along the first transverse fold line to the bottom panel, at least one end flap connected along a second transverse fold line to at least one of the first side panel, the top panel, the second side panel, and the bottom panel, and a plurality of deformation lines in at least two of the first side panel, the second side panel, the adhesive panel, and the first top panel end flap. A carton formed from the blank deforms along at least a plurality of the deformation lines on lifting of the handle. Optionally, the openings can extend to, but not across, the first transverse fold line, or the openings can extend from the top panel, across the first transverse fold line, and into the first top panel end flap. Optionally still, the first end flap can include corner-forming flaps that form a first corner at a first end of a carton formed from the blank. The second end flap includes corner-forming flaps that form a second corner at the first end of a carton formed from the blank. Further, openings can be provided in at least two of the first side panel, the top panel, the second side panel, and the bottom panel.

In yet another aspect, a method of forming a carton from a blank includes folding the first side panel along the first fold line, folding the second side panel along the second fold line, folding the top panel along the third fold line, folding the adhesive panel along the fourth fold line, securing the adhesive panel to the first side panel, folding the first end flap and the second end flap along the first transverse fold line, folding the first bottom end flap along the first transverse fold line, folding the first top end flap along the first transverse fold line, and, securing at least one of the first end flap, the second end flap, the first bottom flap, and the first top end flap together. Alternatively, the first end flap can include corner-forming flaps that form a first corner at a first end of a carton formed from the blank, and folding the first end flap along the first transverse fold line can include folding the first end flap corner-forming flaps to form a first reinforcing corner. Further, the second end flap can include corner-forming flaps that form a second corner at the first end of a carton formed from the blank, and folding the second end flap along the first transverse fold line can include folding the second end flap corner-forming flaps to form a second reinforcing corner. In yet another aspect, the invention includes forming a carton or package from the blanks shown or described herein.

Those skilled in the art will appreciate the above stated advantages and other advantages and benefits of various additional embodiments reading the following detailed description of the embodiments with reference to the below listed drawing figures.

According to common practice, the various features of the drawings discussed below are not necessarily drawn to scale. Dimensions of various features and elements in the drawings may be expanded or reduced to illustrate more clearly the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to blanks, cartons, packages, and methods of use for storing, transporting, and/or dispensing articles or products, such as foodstuffs, etc. The present disclosure also details handle arrangements for moving, carrying, and/or dispensing articles or products in cartons and packages formed from the blanks detailed herein.

Cartons and/or packages according to the present disclosure can accommodate products of numerous different shapes. For the purpose of illustration and not to limit in any manner the scope of the disclosure, the following detailed description describes foodstuffs at least partially disposed within the package embodiments. In this specification, the terms "lower," "bottom," "upper," and "top" indicate orientations determined in relation to fully erected packages.

Figure 1:
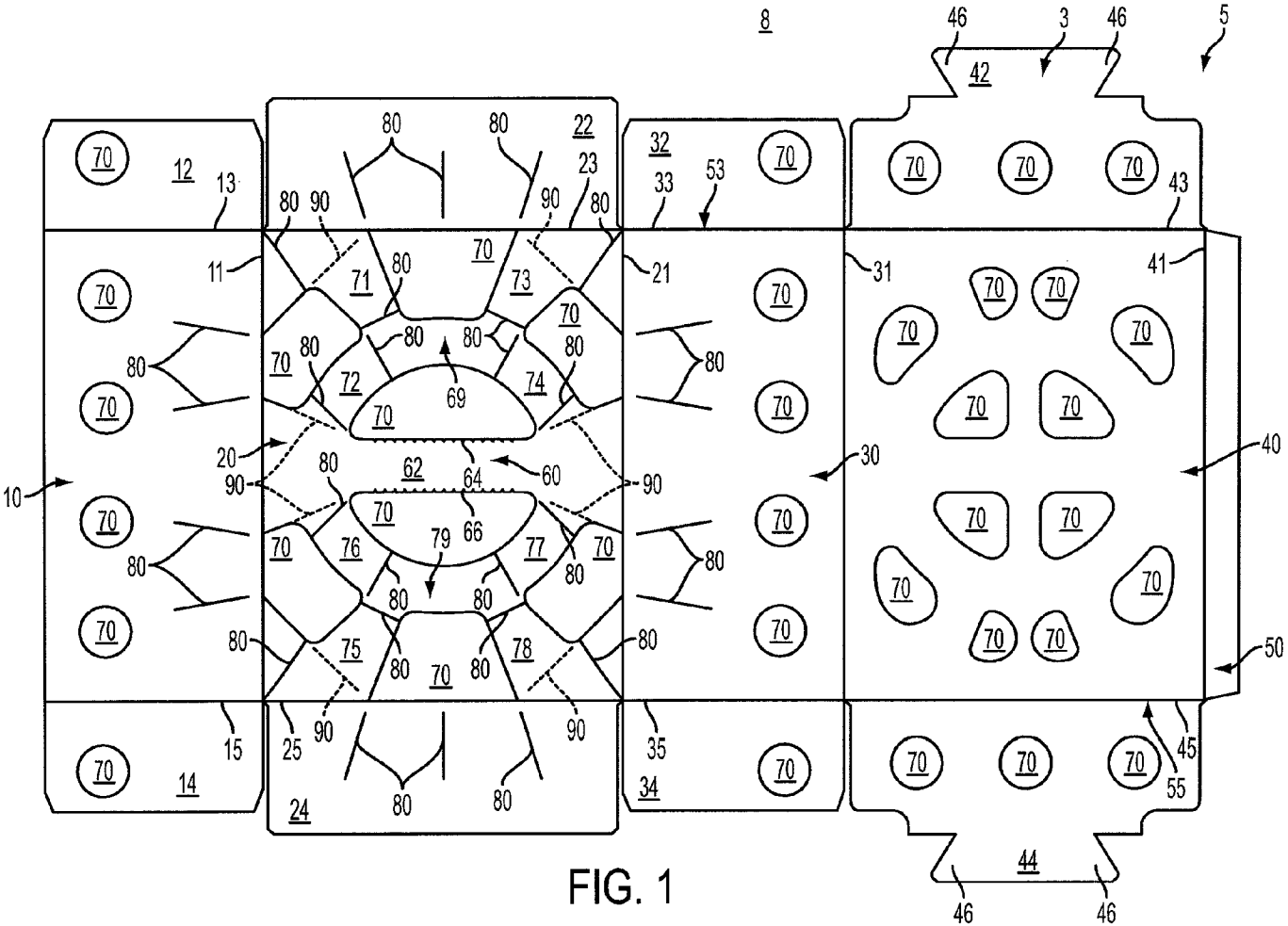
FIG. 1 shows a blank for forming a carton according to a first embodiment of the invention.

FIG. 1 shows a blank 5 for forming a carton according to a first embodiment of the invention. FIG. 1 shows an inside 3 of blank 5 with first side panel 10 connected to a top panel 20 along a fold line 11, the top panel 20 connected to a second side panel 30 along a fold line 21, the second side panel 30 connected to a bottom panel 40 along a fold line 31, the bottom panel 40 connected along a fold line 41 to an adhesive panel 50. Generally, panel 50 or panel 10 receives an adhesive to form blank 5 into a sleeve or carton. Panels 10, 20, 30, and 40 each include a number of end flaps attached along fold lines that are transverse to fold lines 11, 21, 31, and 41. Along a first end of the blank 5, end flap 12 is attached to panel 10 along fold line 13, end flap 22 is attached to panel 20 along fold line 23, end flap 32 is attached to panel 30 along fold line 33, and end flap 42 is attached to panel 40 along fold line 43. One or more of the fold lines 13, 23, 33, 43 can be replaced with a single fold line, such as indicated at 53. Along a second end of blank 5, end flap 14 is attached to panel 10 along fold line 15, end flap 24 is attached to panel 20 along fold line 25, end flap 34 is attached to panel 30 along fold line 35, and end flap 44 is attached to panel 40 along fold line 45. One or more of the fold lines 15, 25, 35, 45 can be replaced with a single fold line, such as indicated at 55. End flaps 12, 14, 22, 24, 32, 34, 42, 44 generally extend in a direction away from respective fold lines 13, 15, 23, 25, 33, 35, 43, 45 or 53, 55 toward periphery 8. End flaps 42 and 44 are shown in FIG. 1 with extension flaps 46, the function of which is described below.

Top panel 20 includes a web-like structure of connecting panels 69 and 79 and a handle 60. The connecting panels 69 and 79 and handle 60 extend between fold lines 11, 21 and 23, 25, and are spaced apart by openings 70. The handle 60 generally extends between fold lines 11 and 21 and includes a handle panel 62 extending between ends 64 and 66. Connecting panel 69 includes panels 71, 72, 73, and 74 connected to handle panel 62 at end 64, and connecting panel 79 includes panels 75, 76, 77, and 78 connected to handle panel 62 at end 66. Connecting panels 69 and 79 include deformation lines 80 that allow the handle 60 to flex and increase strength of the handle 60. As detailed further below, portions of connecting panels 69 and 79 are separable from the top panel 20 along tear lines 90. The tear lines 90 generally are positioned to remove sections of panels 71, 72, 73, 74 between the corners of panel 20 at the intersections of fold lines 11 and 23 and fold lines 21 and 23 and handle end 64. The tear lines 90 generally are positioned to remove sections of panels 75, 76, 77, 78 between the corners of panel 20 at the intersections of fold lines 11 and 25 and fold lines 21 and 25 and handle end 66.

Figure 3:
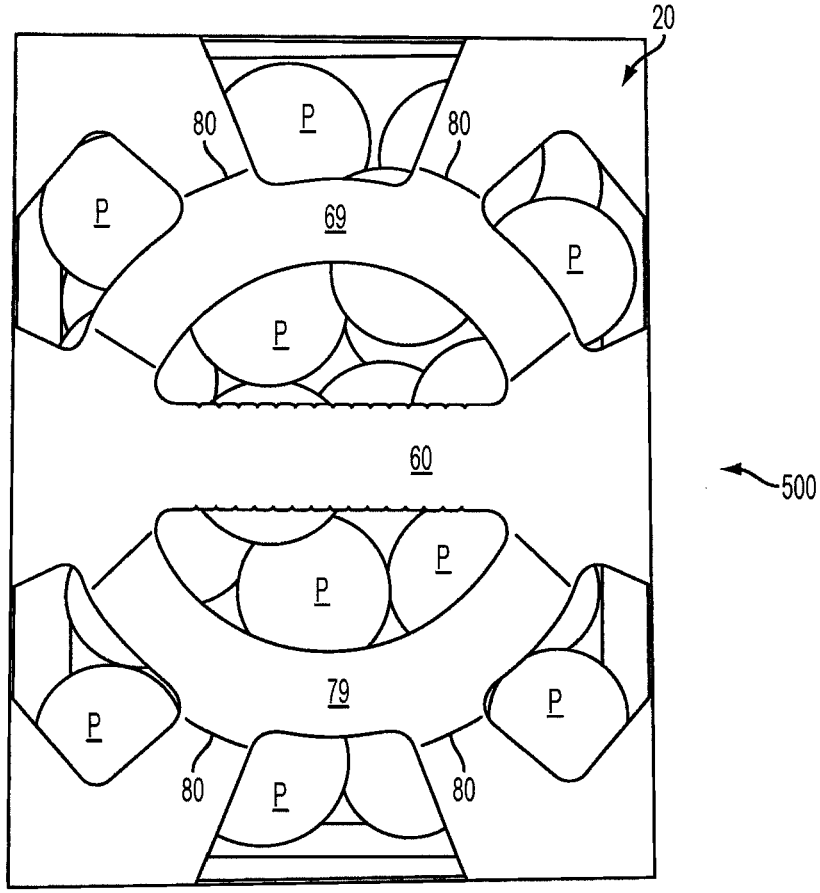
FIG. 3 shows a top view of carton of FIG. 2D.

In addition to those provided in panel 20, deformation lines 80 are provided in first side panel 10, second side panel 30, end flap 22, and end flap 24. These deformation lines 80 also serve to add strength to the handle 60 by providing flexibility. As shown in FIGS. 3, 4D, and 4E, the deformation lines 80 provided in first side panel 10 and in second side panel 30 allow the carton to flex inward at sections of panels 10 and 30 adjacent handle 60.

Openings 70 are provided in several panels and flaps in the blank 5. The openings 70, among other benefits, provide ventilation into or out of the carton, for example, to cool product in the carton, such as fruit or vegetables by allowing air exchange for the interior of the carton. As shown in FIG. 1, openings 70 are provided in panels 10, 20, 30, 40, and in end flaps 12, 14, 32, 34, 42, 44. The openings 70 shown in the figures are exemplary only and can be modified by adjusting the size, number, configuration, and/or location of such openings 70 without deviating from the invention. For example, additional openings 70 can be provided in the panels and flaps shown, or openings 70 can be provided in panels and/or flaps that are not shown with openings 70 in FIG. 1.

Figure 2B:
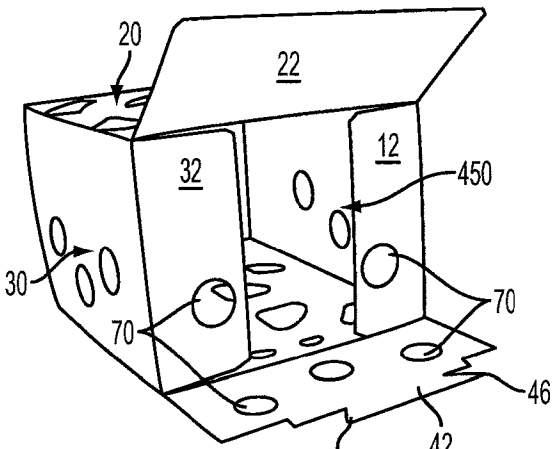
FIGS. 2A through 2D show formation of a first end of an enclosed carton formed from the blank of FIG. 1.
Figure 2D:
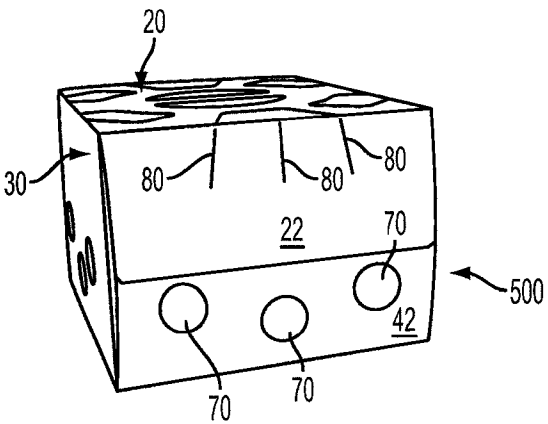
Figure 2A:
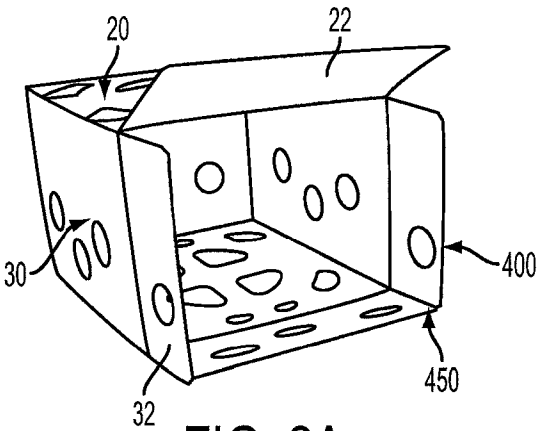
Figure 2C:
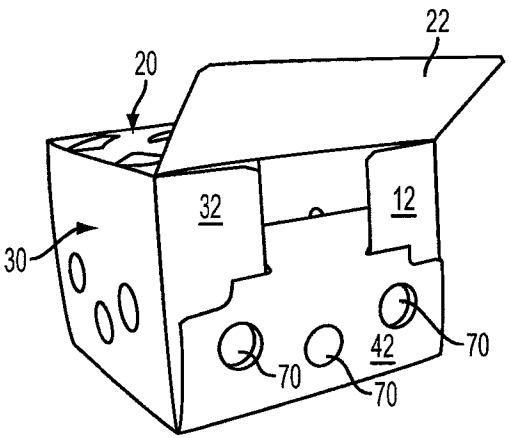

FIGS. 2A through 2D show formation of a first end of an enclosed carton 500 formed from blank 5. As shown in FIG. 2A, the adhesive panel 50 is attached to first side panel 10 to form a sleeve 400 with an interior 450. As shown in FIG. 2B, end flaps 12 and 32 are folded toward the interior 450 of the carton. Next, as shown in FIG. 2C, end flap 42 is folded toward the interior 450 of the carton 500. Extension flaps 46 of end flaps 42 are shown in FIG. 2C sized for receipt into the interior 450 of carton 500 and at least partially secure end flap 42 into contact with end flaps 12 and 32. As shown in FIG. 2D, end flap 22 is folded to close the first end of the carton 500.

Figure 4:
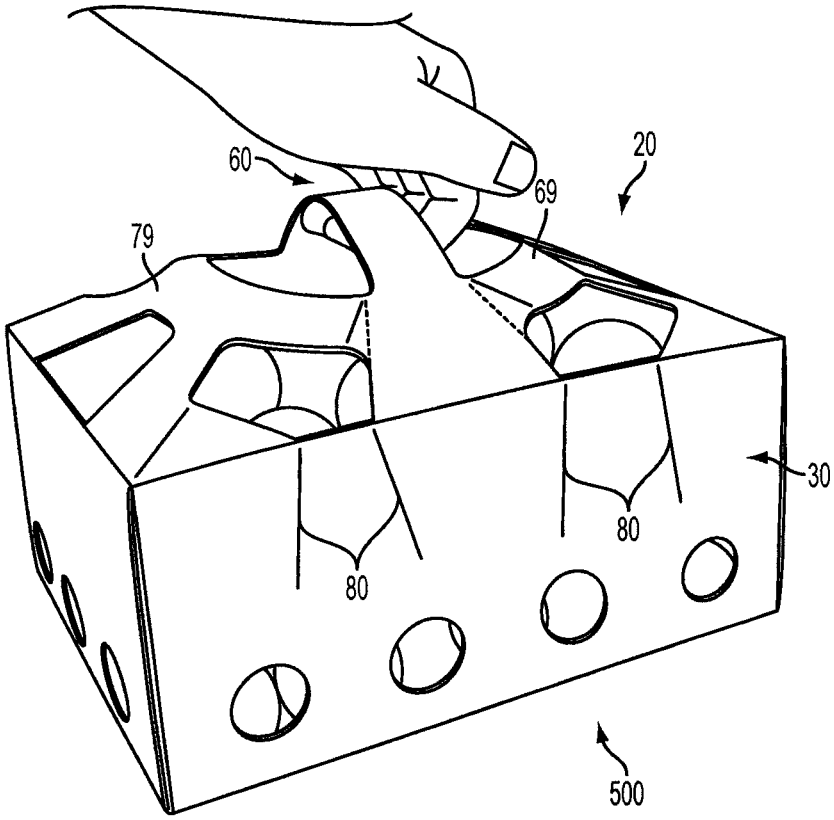
FIG. 4 shows the carton of FIG. 3 being lifted by handle.
Figure 5C:
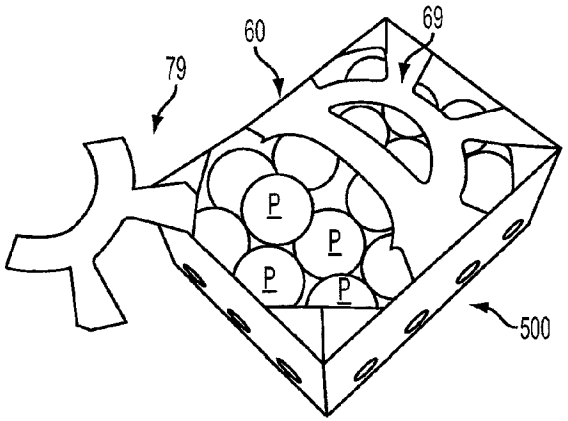
FIGS. 5A through 5E show operation of the handle, separation and removal of the connecting panels from the carton, and operation of the handle after removal of the connecting panels.
Figure 5E:
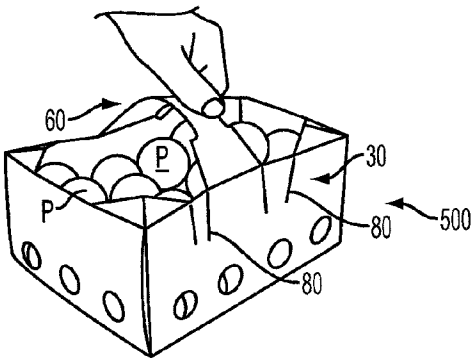
Figure 5B:
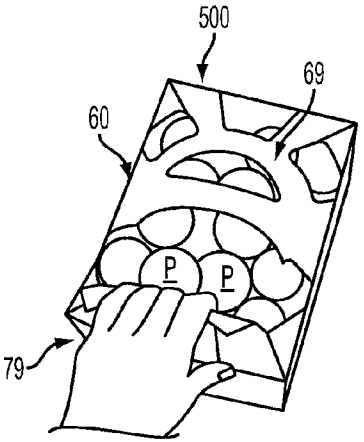
Figure 5D:
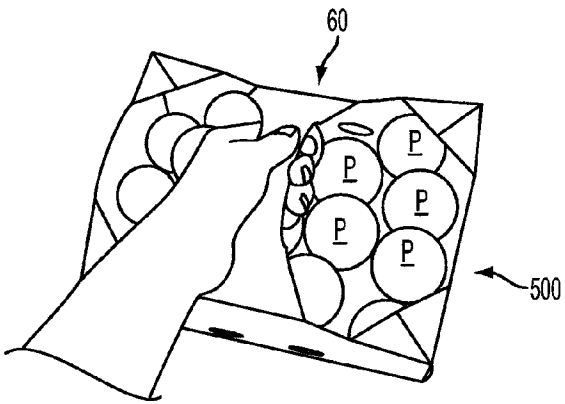
Figure 5A:
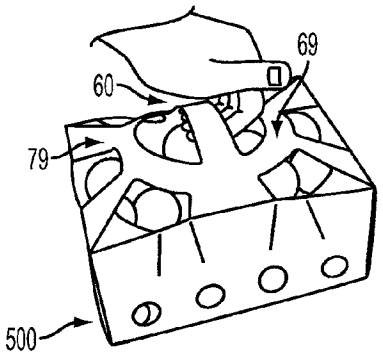

FIG. 3 shows a top view of carton 500 of FIG. 2D. As shown in FIG. 3, product P is disposed in carton 500. FIG. 4 shows carton 500 being lifted by handle 60. As shown in FIG. 4, handle 60, and connecting panels 69 and 79 deform and flex along deformation lines 80.

FIGS. 5A through 5E show operation of the handle 60, separation and removal of the connecting panels 69 and 79 from the carton 500, and operation of the handle 60 after removal of the connecting panels 69 and 79.

Figure 6:
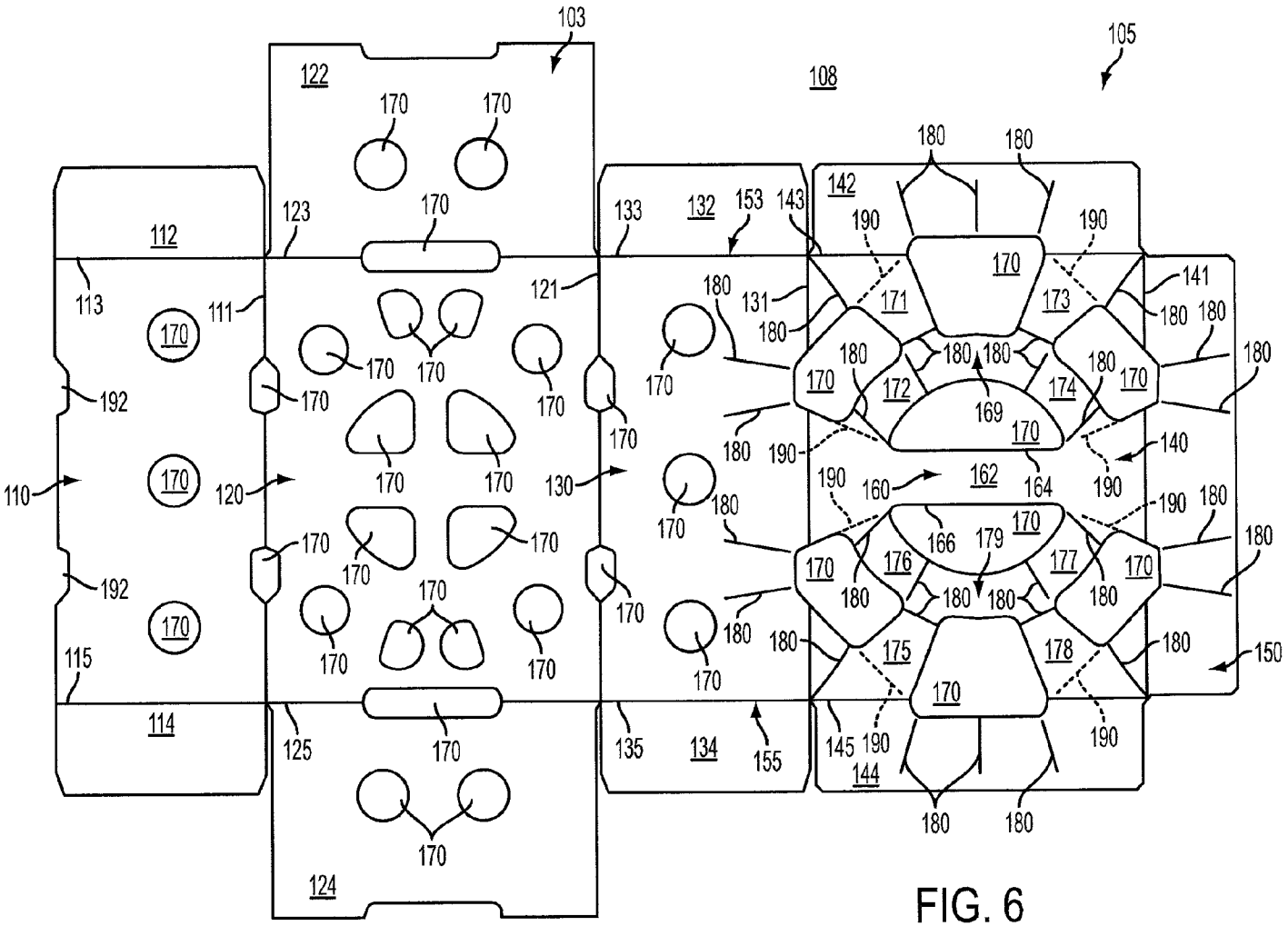
FIG. 6 shows a blank for forming a carton according to a second embodiment of the invention.

FIG. 6 shows a blank 105 for forming a carton according to a second embodiment of the invention. FIG. 6 shows an inside 103 of blank 105 with first side panel 110 connected to a bottom panel 120 along a fold line 111, the bottom panel 120 connected to a second side panel 130 along a fold line 121, the second side panel 130 connected to a top panel 140 along a fold line 131, the top panel 140 connected along a fold line 141 to an adhesive panel 150. Generally, panel 150 or panel 110 receives an adhesive to form blank 105 into a sleeve or carton. Panels 110, 120, 130, and 140 each include a number of end flaps attached along fold lines that are transverse to fold lines 111, 121, 131, and 141. Along a first end of the blank 105, end flap 112 is attached to panel 110 along fold line 113, end flap 122 is attached to panel 120 along fold line 123, end flap 132 is attached to panel 130 along fold line 133, and end flap 142 is attached to panel 140 along fold line 143. One or more of the fold lines 113, 123, 133, 143 can be replaced with a single fold line, such as indicated at 153. Along a second end of blank 105, end flap 114 is attached to panel 110 along fold line 115, end flap 124 is attached to panel 120 along fold line 125, end flap 134 is attached to panel 130 along fold line 135, and end flap 144 is attached to panel 140 along fold line 145. One or more of the fold lines 115, 125, 135, 145 can be replaced with a single fold line, such as indicated at 155. End flaps 112, 114, 122, 124, 132, 134, 142, 144 generally extend in a direction away from respective fold lines 113, 115, 123, 125, 133, 135, 143, 145 or 153, 155 toward periphery 108. Panel 110 includes cutouts 192 at the periphery 108 of blank 105.

Top panel 140 includes a web-like structure of connecting panels 169 and 179 and a handle 160. The connecting panels 169 and 179 and handle 160 extend between fold lines 131, 141 and 143, 145, and are spaced apart by openings 170. The handle 160 generally extends between fold lines 131 and 141 and includes a handle panel 162 extending between ends 164 and 166. Connecting panel 169 includes panels 171, 172, 173, and 174 connected to handle panel 162 at end 164, and connecting panel 179 includes panels 175, 176, 177, and 178 connected to handle panel 162 at end 166. Connecting panels 169 and 179 include deformation lines 180 that allow the handle 160 to flex and increase strength of the handle 160. As detailed further below, portions of connecting panels 169 and 179 are separable from the top panel 140 along tear lines 190. The tear lines 190 generally are positioned to remove sections of panels 171, 172, 173, 174 between the corners of panel 140 at the intersections of fold lines 131 and 143 and fold lines 141 and 143 and handle end 164. The tear lines 190 generally are positioned to remove sections of panels 175, 176, 177, 178 between the corners of panel 140 at the intersections of fold lines 131 and 145 and fold lines 141 and 145 and handle end 166.

In addition to those provided in panel 140, deformation lines 180 are provided in second side panel 130, adhesive panel 150, end flap 142, and end flap 144. These deformation lines 180 also serve to add strength to the handle 160 by providing flexibility. The deformation lines 180 provided in second side panel 130 and in the adhesive panel 150 allow the carton to flex inward at sections of panels 130 and 150 adjacent handle 160.

Openings 170 are provided in several panels and flaps in the blank 105. The openings 170, among other benefits, provide ventilation into or out of the carton, for example, to cool product in the carton, such as fruit or vegetables by allowing air exchange for the interior of the carton. As shown in FIG. 6, openings 170 are provided in panels 110, 120, 130, 140, and 150, and in end flaps 122, 124, 142, 144. The openings 170 shown in the figures are exemplary only and can be modified by adjusting the size, number, configuration, and/or location of such openings 170 without deviating from the invention. For example, additional openings 170 can be provided in the panels and flaps shown, or openings 170 can be provided in panels and/or flaps that are not shown with openings 170 in FIG. 6.

The blank of FIG. 6 differs from the blank in FIG. 1 in several regards, including providing openings 170 that extend across fold lines (the openings 70 in the blank of FIG. 1 extend up to, and along in some instances, but not across any fold lines). Openings 170 extend, for example, from panel 120 across fold line 121 into panel 130, from panel 130 across fold line 131 into panel 140, from panel 140 across fold line 141 into panel 150, from panel 120 across fold line 123 into end flap 122, from panel 120 across fold line 125 into end flap 124, from panel 140 across fold line 143 into end flap 142, and from panel 140 across fold line 145 into end flap 144.

The formation of blank 105 into a sleeve and then into a carton, the use of the handle 160, and the removal of the panels 169 and 179 are similar to those described with reference to blank 5.

Figure 7:
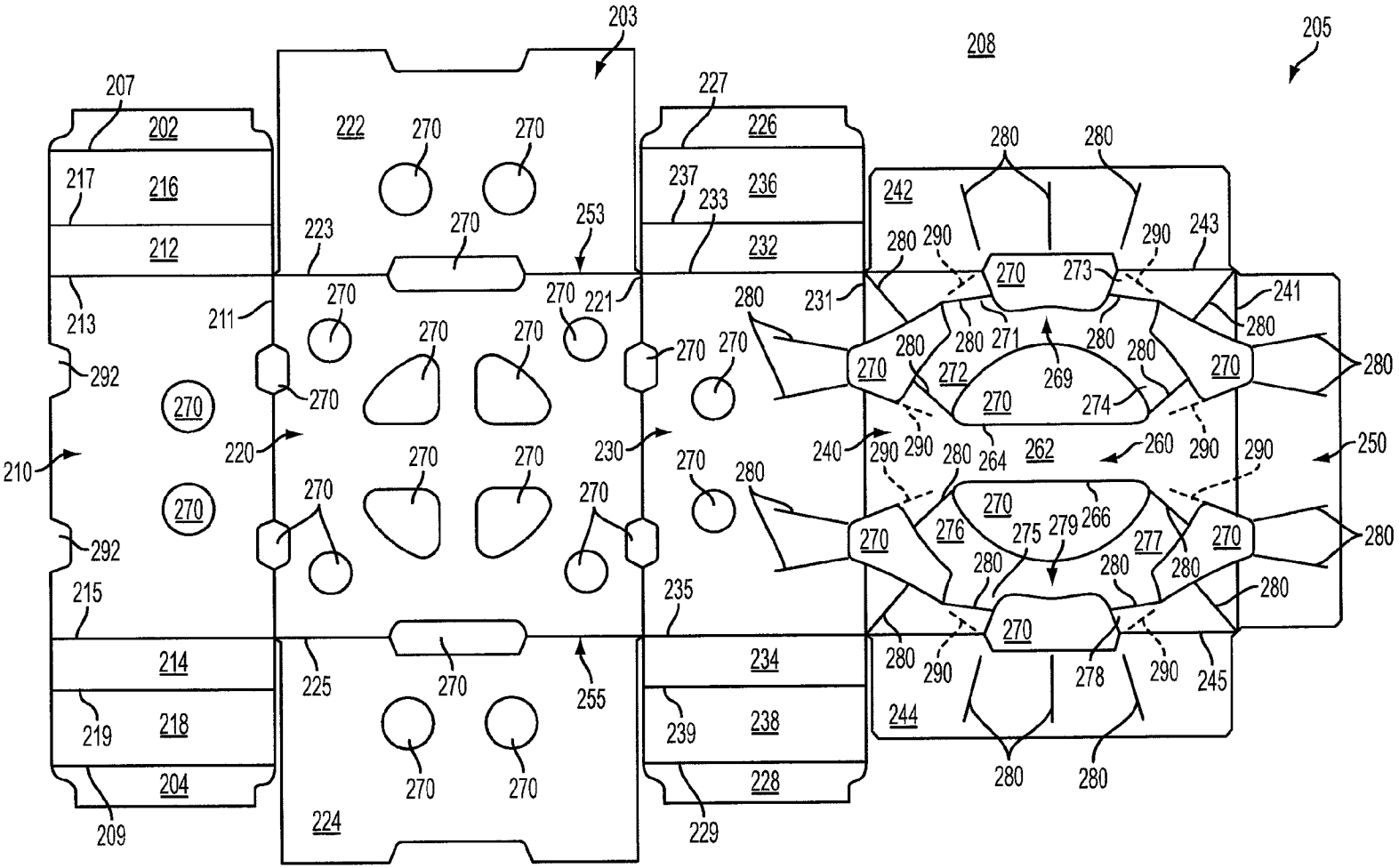
FIG. 7 shows a blank for forming a carton according to a third embodiment of the invention.

FIG. 7 shows a blank 205 for forming a carton according to a third embodiment of the invention. FIG. 7 shows an inside 203 of blank 205 with first side panel 210 connected to a bottom panel 220 along a fold line 211, the bottom panel 220 connected to a second side panel 230 along a fold line 221, the second side panel 230 connected to a top panel 240 along a fold line 231, the top panel 240 connected along a fold line 241 to an adhesive panel 250. Generally, panel 250 or panel 210 receives an adhesive to form blank 205 into a sleeve or carton. Panels 210, 220, 230, and 240 each include a number of end flaps attached along fold lines that are transverse to fold lines 211, 221, 231, and 241. Along a first end of the blank 205, end flap panel 212 is attached to panel 210 along fold line 213, end flap 222 is attached to panel 220 along fold line 223, end flap panel 232 is attached to panel 230 along fold line 233, and end flap 242 is attached to panel 240 along fold line 243. One or more of the fold lines 213, 223, 233, 243 can be replaced with a single fold line, such as indicated at 253. Along a second end of blank 205, end flap 214 is attached to panel 210 along fold line 215, end flap 224 is attached to panel 220 along fold line 225, end flap 234 is attached to panel 230 along fold line 235, and end flap 244 is attached to panel 240 along fold line 245. One or more of the fold lines 215, 225, 235, 245 can be replaced with a single fold line, such as indicated at 255. End flaps 212, 214, 222, 224, 232, 234, 242, 244 generally extend in a direction away from respective fold lines 213, 215, 223, 225, 233, 235, 243, 245 or 253, 255 toward periphery 208. Panel 210 includes cutouts 292 at the periphery 208 of blank 205.

Figure 8B:
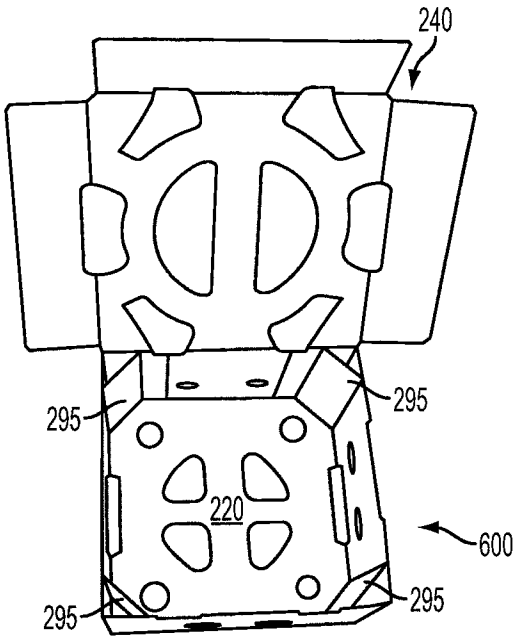
FIGS. 8A and 8B show cartons with reinforced corners formed from the blank of FIG. 7.
Figure 8A:
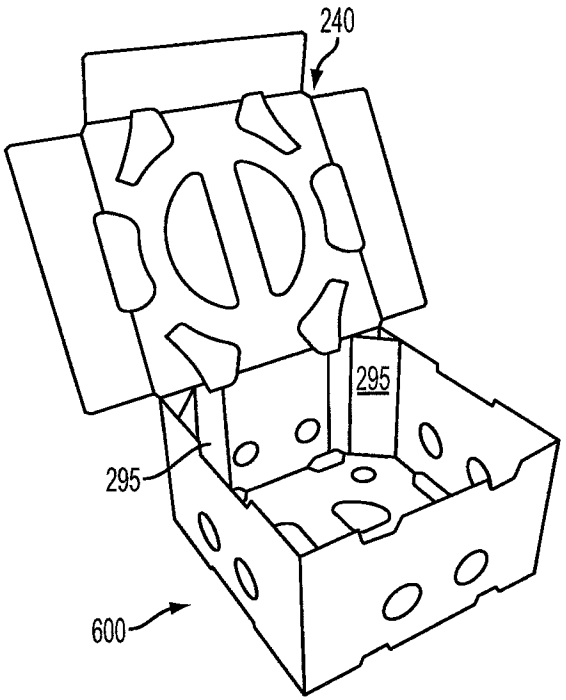
Figure 9:
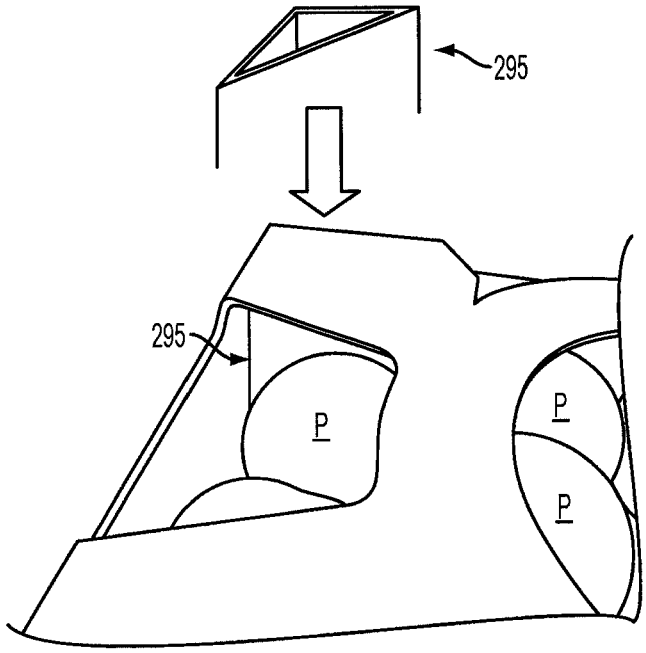
FIG. 9 shows a carton formed from the blank of FIG. 7 with a call-out showing the configuration of a corner.

As shown in FIG. 7, the end flaps connected to each end of panels 210 and 230 include several panels that are foldable about fold lines to form reinforcing corners 295 (shown in FIGS. 8 and 9). Specifically as shown in FIG. 7, end flap panel 216 is connected to end flap panel 212 along fold line 217, and end flap panel 202 is connected to end flap panel 216 along fold line 207. End flap panel 218 is connected to end flap panel 214 along fold line 219, and end flap panel 204 is connected to end flap panel 218 along fold line 209. End flap panel 236 is connected to end flap panel 232 along fold line 237, and end flap panel 226 is connected to end flap panel 236 along fold line 227. End flap panel 238 is connected to end flap panel 234 along fold line 239, and end flap panel 228 is connected to end flap panel 238 along fold line 229.

Top panel 240 includes a web-like structure of connecting panels 269 and 279 and a handle 260. The connecting panels 269 and 279 and handle 260 extend between fold lines 231, 241 and 243, 245, and are spaced apart by openings 270. The handle 260 generally extends between fold lines 231 and 241 and includes a handle panel 262 extending between ends 264 and 266. Connecting panel 269 includes panels 271, 272, 273, and 274 connected to handle panel 262 at end 264, and connecting panel 279 includes panels 275, 276, 277, and 278 connected to handle panel 262 at end 266. Connecting panels 269 and 279 include deformation lines 280 that allow the handle 260 to flex and increase strength of the handle 260. As detailed further below, portions of connecting panels 269 and 279 are separable from the top panel 240 along tear lines 290. The tear lines 290 generally are positioned to remove sections of panels 271, 272, 273, 274 between the corners of panel 240 at the intersections of fold lines 231 and 243 and fold lines 241 and 243 and handle end 264. The tear lines 290 generally are positioned to remove sections of panels 275, 276, 277, 278 between the corners of panel 240 at the intersections of fold lines 231 and 245 and fold lines 241 and 245 and handle end 266.

In addition to those provided in panel 240, deformation lines 280 are provided in second side panel 230, adhesive panel 250, end flap 242, and end flap 244. These deformation lines 280 also serve to add strength to the handle 260 by providing flexibility. The deformation lines 280 provided in second side panel 230 and in the adhesive panel 250 allow the carton to flex inward at sections of panels 230 and 250 adjacent handle 260.

Openings 270 are provided in several panels and flaps in the blank 205. The openings 270, among other benefits, provide ventilation into or out of the carton, for example, to cool product in the carton, such as fruit or vegetables by allowing air exchange for the interior of the carton. As shown in FIG. 7, openings 270 are provided in panels 210, 220, 230, 240, and 250, and in end flaps 222, 224, 242, 244. The openings 270 shown in the figures are exemplary only and can be modified by adjusting the size, number, configuration, and/or location of such openings 270 without deviating from the invention. For example, additional openings 270 can be provided in the panels and flaps shown, or openings 270 can be provided in panels and/or flaps that are not shown with openings 270 in FIG. 7.

The blank of FIG. 7 is similar to FIG. 6 (and differs from the blank of FIG. 1) in several regards, including providing openings 270 that extend across fold lines (the openings 70 in the blank of FIG. 1 extend up to, and along in some instances, but not across any fold lines). Openings 270 extend, for example, from panel 220 across fold line 221 into panel 230, from panel 230 across fold line 231 into panel 240, from panel 240 across fold line 241 into panel 250, from panel 220 across fold line 223 into end flap 222, from panel 220 across fold line 225 into end flap 224, from panel 240 across fold line 243 into end flap 242, and from panel 240 across fold line 245 into end flap 244.

The formation of blank 205 into a sleeve and then into a carton, the use of the handle 260, and the removal of the panels 269 and 279 are similar to those described with reference to blank 5.

FIGS. 8A and 8B, and FIG. 9 show a carton 600 with reinforced corners 295 formed from the blank of FIG. 7. To form the blank 205 into carton 600, a sleeve is generally formed, similar to that shown in FIGS. 2A through 2D. One difference in formation of the cartons shown in FIGS. 2D and 8A and 8B, includes that the end flap panels 202, 216, 204, 218, 226, 236, and 234, 238 are folded about their respective fold lines (and generally, though not necessarily, adhered to respective end flaps 222 or 224) to form reinforcing corners in the interior of carton 600. FIG. 9 shows reinforced corners 295 disposed beneath top panel 240 in enclosed carton 600. The configuration of a corner 295 is shown enlarged in a call-out in FIG. 9. Reinforced corners provide strength to the carton, package, or pack, and, among other benefits, allow the cartons or packages to be stacked, such as on pallets as shown in FIGS. 11 and 12, without damaging the produce or other articles in the cartons or packages. These strength-enhancing features also provide such functionality without affecting the air exchange benefits of openings 270.

Figure 10:
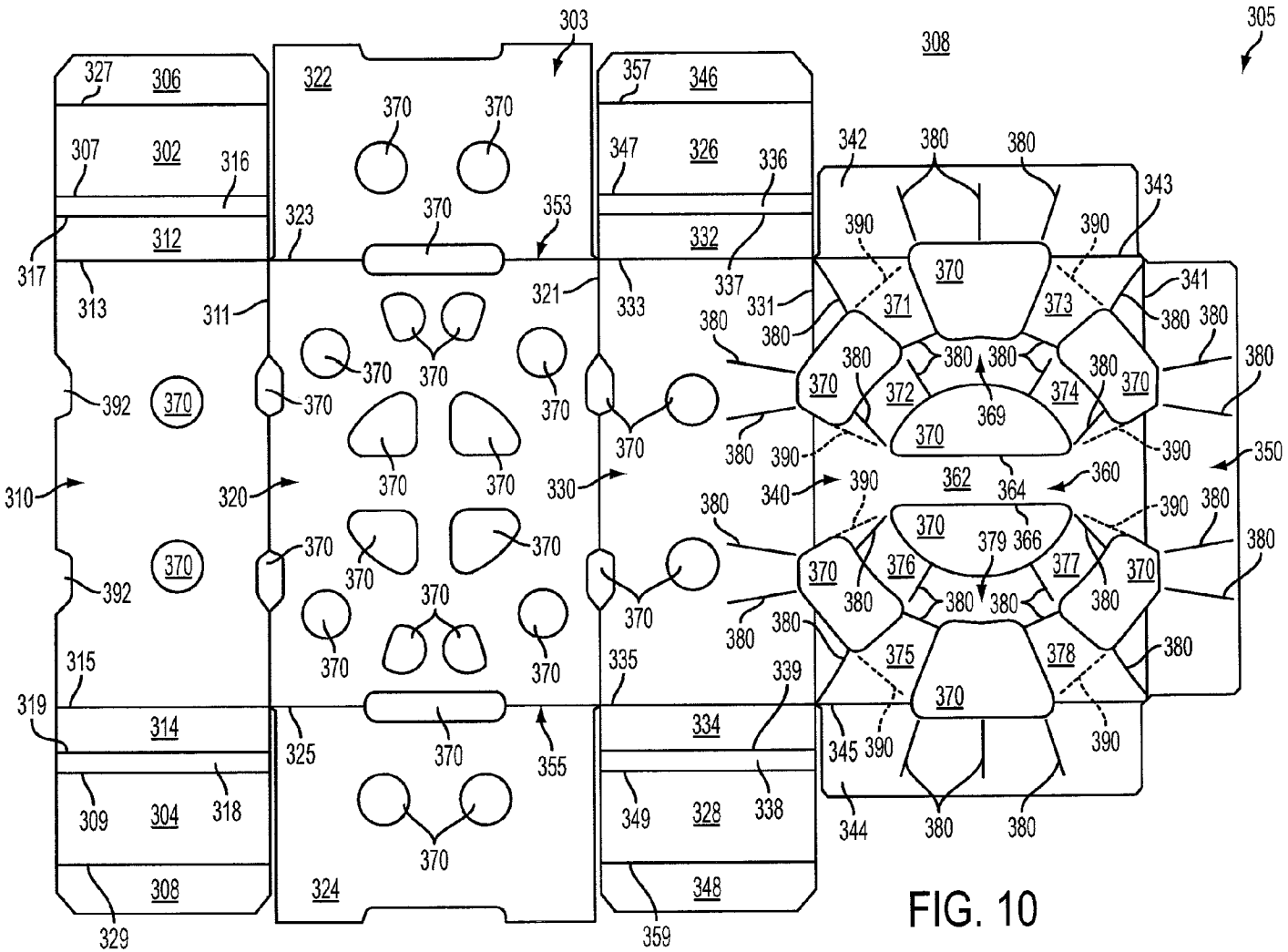
FIG. 10 shows a blank for forming a carton according to a fourth embodiment of the invention.

FIG. 10 shows a blank 305 for forming a carton according to a fourth embodiment of the invention. FIG. 10 shows an inside 303 of blank 305 with first side panel 310 connected to a bottom panel 320 along a fold line 311, the bottom panel 320 connected to a second side panel 330 along a fold line 321, the second side panel 330 connected to a top panel 340 along a fold line 331, the top panel 340 connected along a fold line 341 to an adhesive panel 350. Generally, panel 350 or panel 310 receives an adhesive to form blank 305 into a sleeve or carton. Panels 310, 320, 330, and 340 each include a number of end flaps attached along fold lines that are transverse to fold lines 311, 321, 331, and 341. Along a first end of the blank 305, end flap panel 312 is attached to panel 310 along fold line 313, end flap 322 is attached to panel 320 along fold line 323, end flap panel 332 is attached to panel 330 along fold line 333, and end flap 342 is attached to panel 340 along fold line 343. One or more of the fold lines 313, 323, 333, 343 can be replaced with a single fold line, such as indicated at 353. Along a second end of blank 305, end flap 314 is attached to panel 310 along fold line 315, end flap 324 is attached to panel 320 along fold line 325, end flap 334 is attached to panel 330 along fold line 335, and end flap 344 is attached to panel 340 along fold line 345. One or more of the fold lines 315, 325, 335, 345 can be replaced with a single fold line, such as indicated at 355. End flaps 312, 314, 322, 324, 332, 334, 342, 344 generally extend in a direction away from respective fold lines 313, 315, 323, 325, 333, 335, 343, 345 or 353, 355 toward periphery 308. Panel 310 includes cutouts 392 at the periphery 308 of blank 305.

As shown in FIG. 10, the end flaps connected to each end of panels 310 and 330 include several panels that are foldable about fold lines to form reinforcing corners 395. Specifically as shown in FIG. 10, end flap panel 316 is connected to end flap panel 312 along fold line 317, end flap panel 302 is connected to end flap panel 316 along fold line 307, and end flap panel 306 is connected to end flap panel 302 along fold line 327. End flap panel 318 is connected to end flap panel 314 along fold line 319, end flap panel 304 is connected to end flap panel 318 along fold line 309, and end flap panel 308 is connected to end flap panel 304 along fold line 329. End flap panel 336 is connected to end flap panel 332 along fold line 337, end flap panel 326 is connected to end flap panel 336 along fold line 347, and end flap panel 346 is connected to end flap panel 326 along fold line 357. End flap panel 338 is connected to end flap panel 334 along fold line 339, end flap panel 328 is connected to end flap panel 338 along fold line 349, and end flap panel 348 is connected to end flap panel 328 along fold line 359.

Top panel 340 includes a web-like structure of connecting panels 369 and 379 and a handle 360. The connecting panels 369 and 379 and handle 360 extend between fold lines 331, 341 and 343, 345, and are spaced apart by openings 370. The handle 360 generally extends between fold lines 331 and 341 and includes a handle panel 362 extending between ends 364 and 366. Connecting panel 369 includes panels 371, 372, 373, and 374 connected to handle panel 362 at end 364, and connecting panel 379 includes panels 375, 376, 377, and 378 connected to handle panel 362 at end 366. Connecting panels 369 and 379 include deformation lines 380 that allow the handle 360 to flex and increase strength of the handle 360. As detailed further below, portions of connecting panels 369 and 379 are separable from the top panel 340 along tear lines 390. The tear lines 390 generally are positioned to remove sections of panels 371, 372, 373, 374 between the corners of panel 340 at the intersections of fold lines 331 and 343 and fold lines 341 and 343 and handle end 364. The tear lines 390 generally are positioned to remove sections of panels 375, 376, 377, 378 between the corners of panel 340 at the intersections of fold lines 331 and 345 and fold lines 341 and 345 and handle end 366.

In addition to those provided in panel 340, deformation lines 380 are provided in second side panel 330, adhesive panel 350, end flap 342, and end flap 344. These deformation lines 380 also serve to add strength to the handle 360 by providing flexibility. The deformation lines 380 provided in second side panel 330 and in the adhesive panel 350 allow the carton to flex inward at sections of panels 330 and 350 adjacent handle 360.

Openings 370 are provided in several panels and flaps in the blank 305. The openings 370, among other benefits, provide ventilation into or out of the carton, for example, to cool product in the carton, such as fruit or vegetables by allowing air exchange for the interior of the carton. As shown in FIG. 7, openings 370 are provided in panels 310, 320, 330, 340, and 350, and in end flaps 322, 324, 342, 344. The openings 370 shown in the figures are exemplary only and can be modified by adjusting the size, number, configuration, and/or location of such openings 370 without deviating from the invention. For example, additional openings 370 can be provided in the panels and flaps shown, or openings 370 can be provided in panels and/or flaps that are not shown with openings 370 in FIG. 7.

The blank of FIG. 10 is similar to FIGS. 6 and 7 (and differs from the blank of FIG. 1) in several regards, including providing openings 370 that extend across fold lines. Openings 370 extend, for example, from panel 320 across fold line 321 into panel 330, from panel 330 across fold line 331 into panel 340, from panel 340 across fold line 341 into panel 350, from panel 320 across fold line 323 into end flap 322, from panel 320 across fold line 325 into end flap 324, from panel 340 across fold line 343 into end flap 342, and from panel 340 across fold line 345 into end flap 344.

The formation of blank 305 into a sleeve and then into a carton, the use of the handle 360, and the removal of the panels 369 and 379 are similar to those described with reference to blank 5.

To form the blank 305 into a carton, a sleeve is generally formed, similar to that shown in FIGS. 2A through 2D, to form a carton similar to FIGS. 8 and 9. One difference in formation of the cartons shown in FIGS. 2D and 8, includes that the end flap panels 302, 306, 316, and 304, 308, 318, and 326, 336, 346, and 328, 338, 348 are folded about their respective fold lines (and generally, though not necessarily, adhered to respective end flaps 322 or 324) to form reinforcing corners in the interior of a carton. Reinforced corners provide strength to the carton, package, or pack, and, among other benefits, allow the cartons or packages to be stacked, such as on pallets as shown in FIGS. 11 and 12, without damaging the produce or other articles in the cartons or packages. These strength-enhancing features also provide such functionality without affecting the air exchange benefits of openings 370.

Figure 11C:
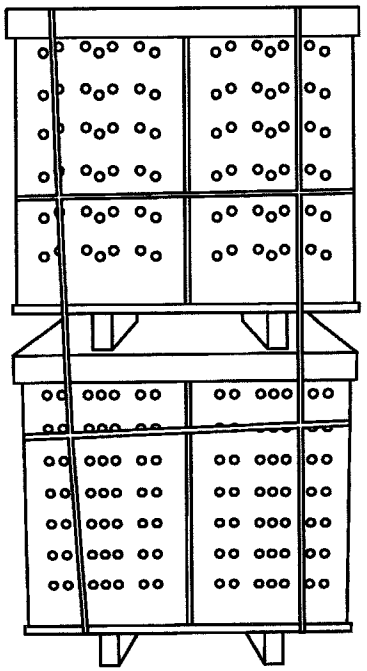
FIGS. 11A through 11C and FIG. 12 show cartons stacked on pallets with the openings providing ventilation throughout.
Figure 11B:
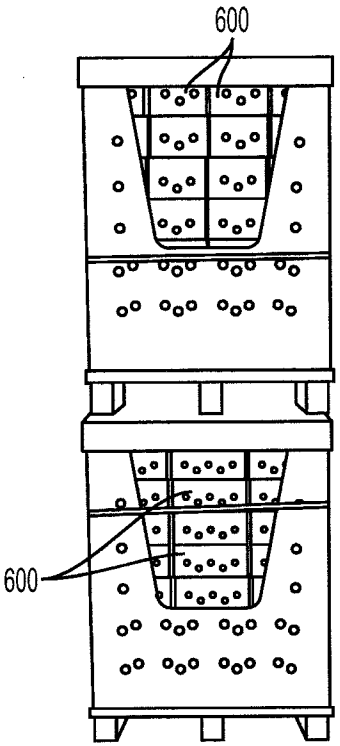
Figure 11A:
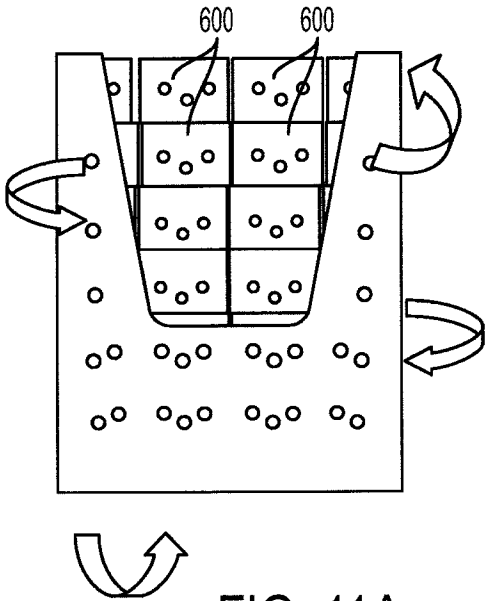
Figure 12:
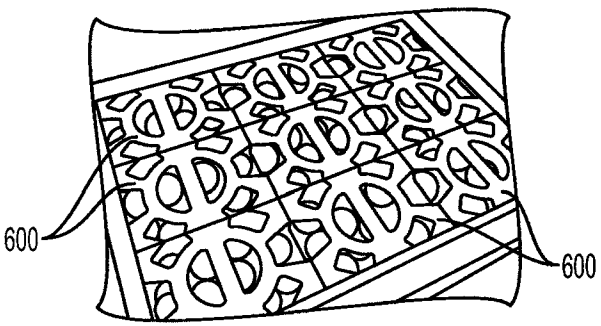

FIGS. 11A through 11C, and 12 show cartons stacked on pallets with the openings providing ventilation throughout. FIGS. 11A through 11C show circulation arrows and different configurations of cartons or pallets. FIG. 12 shows a top view of a pallet or transport mechanism of multiple cartons 600.

Alternatively, the blanks, carton, or packages detailed herein could include single features shown or described herein. For example, in lieu of providing a handle in the top panel, the blank, carton, or package could include corner features alone, or could include corner features in only one or more corners (less than all four corners shown). Further, items other than fruit or vegetables could be transported or stored in the carton or package shown.

The blanks according to the present disclosure can be formed, for example, from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having a liner attached to the carton and/or one or more carton panels adhered together by glue during erection. The term "glue" is intended to encompass all manner of adhesives commonly used to secure carton panels or flaps in place.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton comprising:

a first side panel;

a second side panel;

a top panel;

a bottom panel;

an adhesive panel;

the top panel including a handle panel and a plurality of connecting panels;

a plurality of openings in the top panel, the plurality of openings comprising a first handle opening, a second handle opening, and at least one connecting panel opening, each of the first handle opening, and the second handle opening being located adjacent the handle panel, and the at least one connecting panel opening being located adjacent at least two of the connecting panels; and a plurality of deformation lines in at least two of the first side panel, the second side panel, and the adhesive panel;

wherein the carton deforms along at least some of the deformation lines on lifting of the handle panel.

2. The carton of claim 1 wherein each end of the top panel includes a top panel end flap connected to the top panel along a transverse fold line, and wherein the plurality of deformation lines include deformation lines in each top panel end flap.

3. The carton of claim 2 wherein the at least one connecting panel opening extends to, but not across, a respective transverse fold line.

4. The carton of claim 2 wherein the at least one connecting panel opening extends from the top panel, across a respective transverse fold line, and into a respective- top panel end flap.

5. The carton of claim 1 wherein the first side panel and the top panel are connected along a first fold line.

6. The carton of claim 5 wherein the at least one connecting opening extends to, but not across, the first fold line.

7. The carton of claim 5 wherein the at least one connecting opening extends from the top panel, across the first fold line, and into the first side panel.

8. The carton of claim 1 wherein first side panel end flaps are connected along a first transverse fold line to the first side panel at a first end of the carton, and wherein the first side panel end flaps include corner forming end flaps that form a first reinforced corner in an interior space of the carton at the first end of the carton, and a first bottom panel end flap is foldably connected to the bottom panel along the first transverse fold line, the first bottom panel end flap forms a first exterior corner that is spaced from the first reinforced corner.

9. The carton of claim 8 wherein second side panel end flaps are connected along a second transverse fold line to the first side panel at a second end of the carton, and wherein the second side panel end flaps include corner forming end flaps that form a second reinforced corner in the interior space of the carton at the second end of the carton, and the first bottom panel end flap forms a second exterior corner that is spaced from the second reinforced corner.

10. The carton of claim 9 wherein third side panel end flaps are connected along the first transverse fold line to the second side panel at the first end of the carton, and wherein the third side panel end flaps include corner forming end flaps that form a third reinforced corner in the interior space of the carton at the first end of the carton, and a second bottom panel end flap is foldably connected to the bottom panel along the second transverse fold line, the second bottom panel end flap forms a third exterior corner that is spaced from the third reinforced corner.

11. The carton of claim 10 wherein fourth side panel end flaps are connected along the second transverse fold line to the second side panel at the second end of the carton, and wherein the fourth side panel end flaps include corner forming end flaps that form a fourth reinforced corner in the interior space of the carton at the second end of the carton, and the second bottom panel end flap forms a fourth exterior corner that is spaced from the fourth reinforced corner.

12. The carton of claim 11 wherein side openings are provided in at least two of the first side panel, the top panel, the second side panel, and the bottom panel.

13. The carton of claim 1 wherein side openings are provided in at least two of the first side panel, the top panel, the second side panel, and the bottom panel.

14. A blank comprising:

a first side panel connected along a first fold line to a top panel;

the top panel connected along a second fold line to a second side panel;

the second side panel connected along a third fold line to a bottom panel;

the bottom panel connected along a fourth fold line to an adhesive panel;

the top panel including a handle panel and a plurality of connecting panels spaced apart by a plurality of openings, the plurality of openings including a first handle opening, a second handle opening and at least one connecting panel opening, each of the first handle opening and the second handle opening being located adjacent the handle panel, and the at least one connecting panel opening being located adjacent at least two of the connecting panels;

a first side panel end flap connected along a first transverse fold line to the first side panel;

a first top panel end flap connected along the first transverse fold line to the top panel;

a second side panel end flap connected along the first transverse fold line to the second side panel;

a first bottom panel end flap connected along the first transverse fold line to the bottom panel;

at least one end flap connected along a second transverse fold line to at least one of the first side panel, the top panel, the second side panel, and the bottom panel; and a plurality of deformation lines in at least two of the first side panel, the second side panel, the adhesive panel, and the first top panel end flap;

wherein a carton formed from the blank deforms along at least a plurality of the deformation lines on lifting of the handle panel.

15. The blank of claim 14 wherein the at least one connecting opening extends to, but not across, the first transverse fold line.

16. The blank of claim 14 wherein the at least one connecting opening extends from the top panel, across the first transverse fold line, and into the first top panel end flap.

17. The blank of claim 14 wherein the at least one connecting opening extends to, but not across, the first fold line.

18. The blank of claim 14 wherein the at least one connecting opening extends from the top panel, across the first fold line, and into the first side panel.

19. The blank of claim 14 wherein the first side panel end flap includes corner-forming flaps that form a first reinforced corner at a first end of a carton formed from the blank.

20. The blank of claim 19 wherein the second side panel end flap includes corner-forming flaps that form a second reinforced corner at the first end of a carton formed from the blank.

21. The blank of claim 14 wherein side openings are provided in at least two of the first side panel, the top panel, the second side panel, and the bottom panel.

22. A carton formed from the blank of claim 14.

23. A package comprising a plurality of containers and a carton formed from the blank of claim 14.

24. A method of forming a carton comprising:

providing a blank, the blank comprising:

a first side panel connected along a first fold line to a top panel;

the top panel connected along a second fold line to a second side panel;

the second side panel connected along a third fold line to a bottom panel;

the bottom panel connected along a fourth fold line to an adhesive panel;

the top panel including a handle panel and a plurality of connecting panels spaced apart by a plurality of openings, the plurality of openings including a first handle opening, a second handle opening and at least one connecting panel opening, each of the first handle opening and the second handle opening being located adjacent the handle panel, and the at least one connecting panel opening being located adjacent at least two of the connecting panels;

a first side panel end flap connected along a first transverse fold line to the first side panel;

a first top panel end flap connected along the first transverse fold line to the top panel;

a second side panel end flap connected along the first transverse fold line to the second side panel;

a first bottom panel end flap connected along the first transverse fold line to the bottom panel;

at least one end flap connected along a second transverse fold line to at least one of the first side panel, the top panel, the second side panel, and the bottom panel; and a plurality of deformation lines in at least two of the first side panel, the second side panel, the adhesive panel, and the first top panel end flap;

wherein the carton formed from the blank deforms along at least a plurality of the deformation lines on lifting of the handle panel;

folding the first side panel along the first fold line;

folding the second side panel along the second fold line;

folding the bottom panel along the third fold line;

folding the adhesive panel along the fourth fold line;

securing the adhesive panel to the first side panel;

folding the first side panel end flap and the second side panel end flap along the first transverse fold line;

folding the first bottom panel end flap along the first transverse fold line;

folding the first top panel end flap along the first transverse fold line; and, securing at least one of the first side panel end flap, the second side panel end flap, the first bottom panel end flap, and the first top panel end flap together.

25. The method of claim 24 wherein the first side panel end flap includes corner-forming flaps that form a first reinforced corner at a first end of a carton formed from the blank, and wherein folding the first side panel end flap along the first transverse fold line includes folding the corner-forming flaps to form the first reinforced corner in the interior space of the carton.

26. The method of claim 24 wherein the second side panel end flap includes corner-forming flaps that form a second reinforced corner at the first end of a carton formed from the blank, and wherein folding the second side panel end flap along the first transverse fold line includes folding the corner-forming flaps to form the second reinforced corner in an interior space of the carton.

* * * * *